US010342397B1

(12) United States Patent
Rosenberg

(10) Patent No.: US 10,342,397 B1
(45) Date of Patent: Jul. 9, 2019

(54) VEHICLE TISSUE DISPENSER

(71) Applicant: Kymberly Rosenberg, Forney, TX (US)

(72) Inventor: Kymberly Rosenberg, Forney, TX (US)

( * ) Notice: Subject to any disclaimer, the term of this patent is extended or adjusted under 35 U.S.C. 154(b) by 0 days.

(21) Appl. No.: 15/911,081

(22) Filed: Mar. 3, 2018

Related U.S. Application Data

(60) Provisional application No. 62/469,736, filed on Mar. 10, 2017.

(51) Int. Cl.

| | |
|---|---|
| ***A47K 10/42*** | (2006.01) |
| ***B65D 83/08*** | (2006.01) |
| *B65D 25/20* | (2006.01) |
| *A47K 10/32* | (2006.01) |

(52) U.S. Cl.
CPC ..... *A47K 10/426* (2013.01); *B65D 83/0805* (2013.01); *A47K 2010/3233* (2013.01); *B65D 25/20* (2013.01)

(58) Field of Classification Search
USPC ..... 221/34, 35, 92
See application file for complete search history.

(56) References Cited

U.S. PATENT DOCUMENTS

| | | | | |
|---|---|---|---|---|
| 6,119,892 | A * | 9/2000 | Laurent | A61J 7/0084 221/131 |
| 2006/0086748 | A1* | 4/2006 | Burns | A47K 10/426 221/35 |
| 2011/0011879 | A1* | 1/2011 | Johnson | A47K 10/422 221/45 |
| 2018/0037356 | A1* | 2/2018 | DeMatteis | B65B 67/1227 |

* cited by examiner

*Primary Examiner* — Gene O Crawford
*Assistant Examiner* — Ayodeji T Ojofeitimi
(74) *Attorney, Agent, or Firm* — Kenneth L Tolar

(57) ABSTRACT

A tissue dispenser includes a hollow housing having a front surface, a rear surface, and two opposing hinged side doors that provide selective access to an interior tissue chamber. Each side door includes a dispensing slot through which a tissue is dispensed from the tissue chamber. On the rear surface are a pair of spring-biased, V-shaped clamps for releasably gripping a side edge of a passenger seat. Accordingly, when the housing is secured to the vehicle passenger seat, a tissue can be removed from either slot, thereby providing easy access by a passenger sealed within either the front or rear seats.

7 Claims, 4 Drawing Sheets

VEHICLE TISSUE DISPENSER

CROSS REFERENCE TO RELATED APPLICATIONS

This application claims the benefit of provisional patent application No. 62/469,736 filed on Mar. 10, 2017, the specification of which is incorporated herein by reference.

BACKGROUND OF THE INVENTION

The present invention relates to a tissue dispenser for a vehicle passenger compartment.

DESCRIPTION OF THE PRIOR ART

To maintain a convenient supply of tissues, a driver typically purchases a conventional cardboard tissue dispenser and places it on a center console. However, whenever the vehicle is moving, the lightweight dispenser is easily tossed onto the floor or between seats. When a tissue is needed, a driver or passenger must search the passenger compartment, which is laborious and inconvenient. Furthermore, when resting on a floorboard, the tissues are often trampled and ruined.

Accordingly, there is currently a need for a tissue dispenser that can be easily and securely mounted within a vehicle passenger compartment. The present invention addresses this need by providing a dispenser that is easily attachable to a side edge of a passenger seat.

SUMMARY OF THE INVENTION

The present invention relates to a tissue dispenser comprising a hollow housing having a front surface, a rear surface, and two opposing, hinged side doors that provide selective access to an interior tissue chamber. Each side door includes a dispensing slot through which a tissue is dispensed from a stack in the tissue chamber. On the rear surface of the housing are a pair of spring-biased, D-shaped clamps for releasably gripping a side edge of a passenger seat. Accordingly, when the housing is secured to the vehicle passenger seat, a tissue can be removed from either slot, thereby providing easy access by a passenger seated within either the front or rear seats.

It is therefore an object of the present invention to provide a tissue dispenser that is conveniently attachable to a vehicle passenger seat.

It is therefore another object of the present invention to provide a tissue dispenser that allows passengers in both the rear and front seats to easily access tissues.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
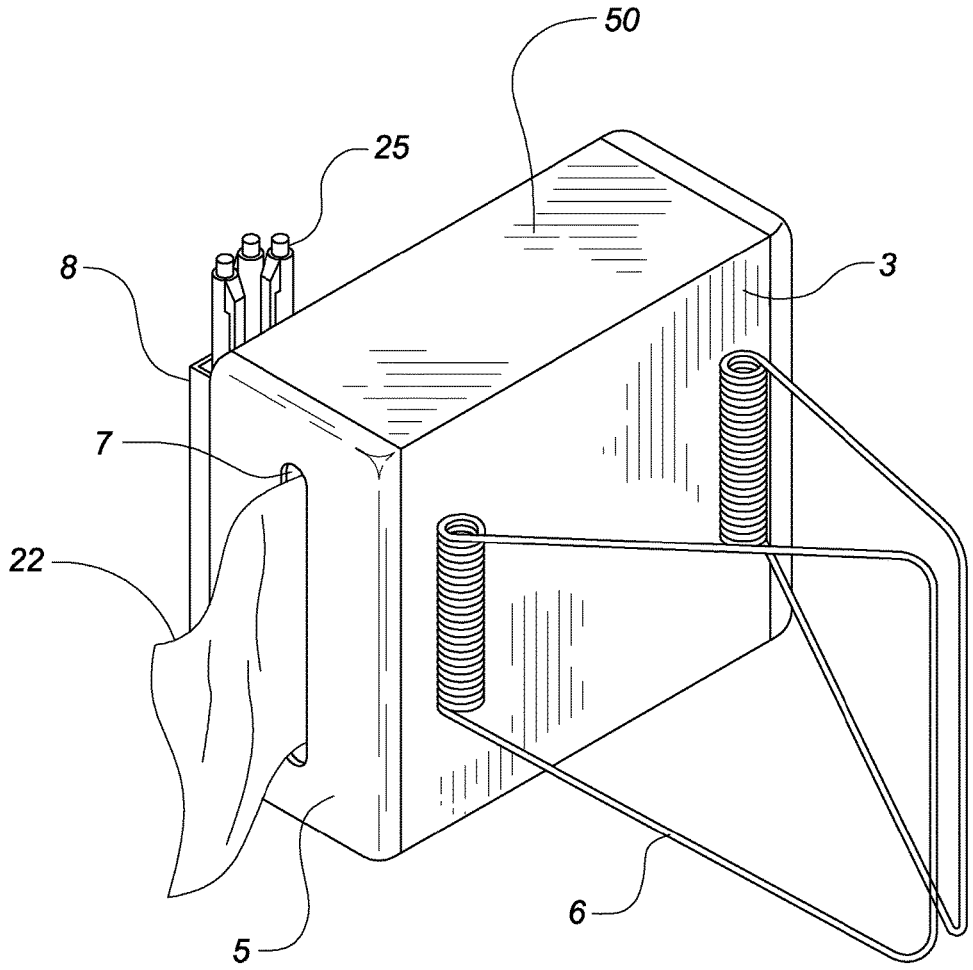
FIG. 1 is a rear perspective view of the tissue dispenser according to the present invention.
Figure 2:
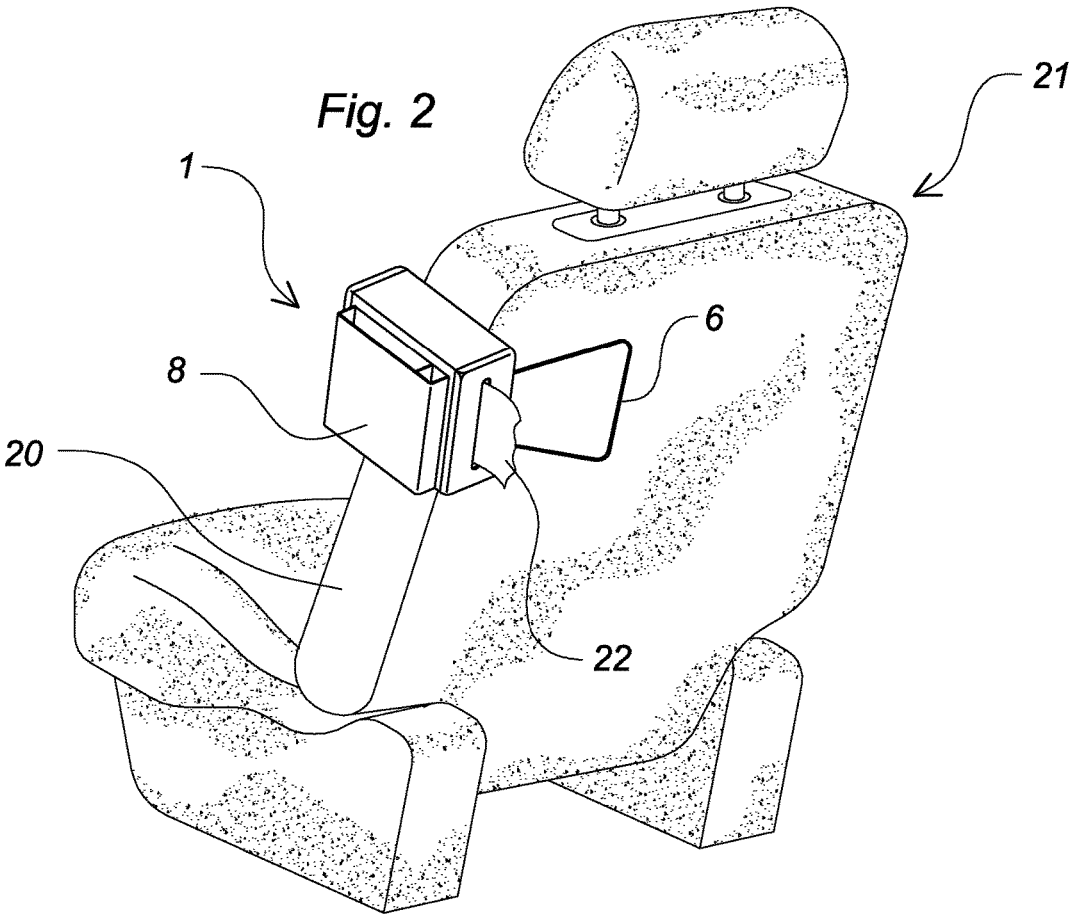
FIG. 2 depicts the tissue dispenser attached to a vehicle passenger seat.
Figure 3:
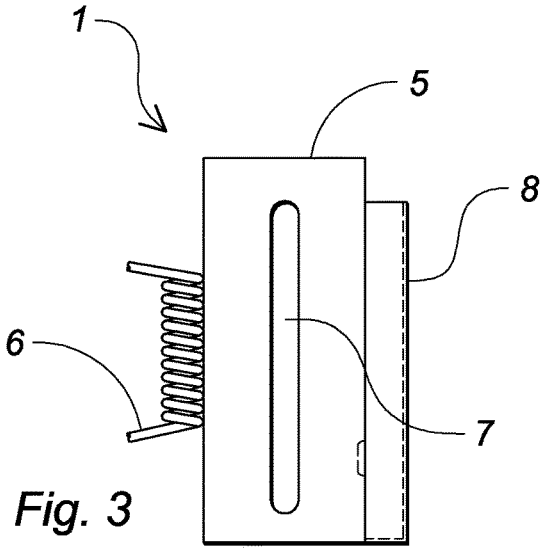
FIG. 3 is a side, plan view of the tissue dispenser.
Figure 4:
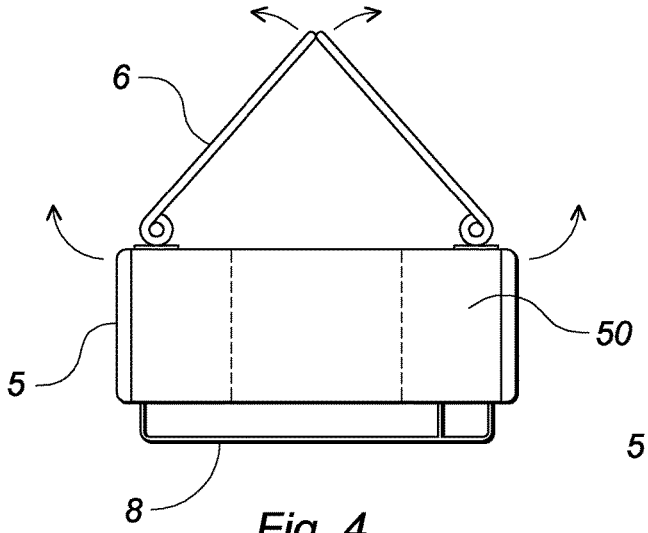
FIG. 4 is a top view of the tissue dispenser.
Figure 5:
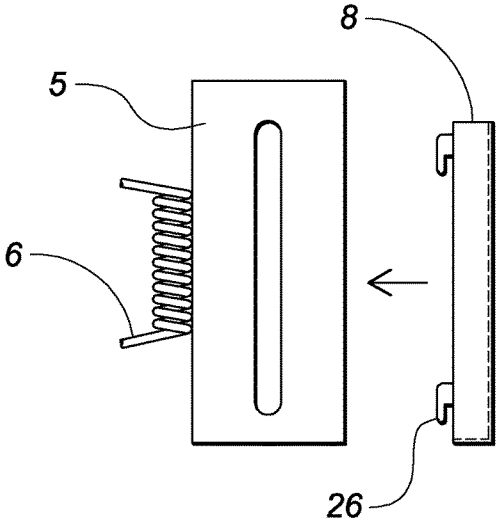
FIG. 5 is an exploded view of the tissue dispenser depicted in FIG. 3.
Figure 6:
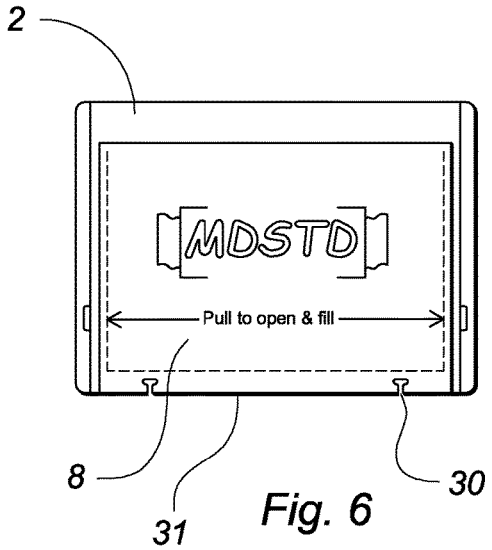
FIG. 6 is a front view of the tissue dispenser.
Figure 7:
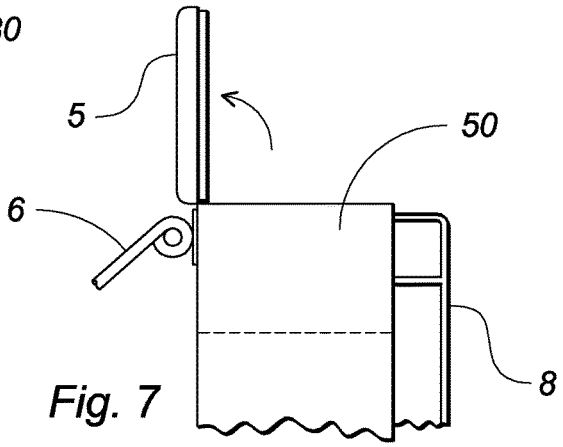
FIG. 7 is a top, sectional view of the housing with a side door in the open position.

The present invention relates to a tissue dispenser comprising a hollow housing 1 having a front surface 2, a rear surface 3, a top wall 50, a bottom wall 31 and two opposing, hinged side doors 5 that provide selective access to an interior tissue chamber. Each door 5 includes a releasable closure mechanism for maintaining the door in a closed position until forcibly opened. On the rear surface of the housing are a pair of spring-biased, D-shaped clamps 6 for releasably gripping a side edge 20 of a passenger seat 21 or any other convenient support surface. Each of the side doors includes a dispensing slot 7 in communication with the interior tissue chamber where a stack of tissues 22 are stored. Each tissue chamber includes a retainer for gripping a lowermost tissue to maintain the stack in a proper orientation when a tissue is pulled through the slot 7.

On the front surface of the housing is a detachable storage compartment 8 for retaining pens 25, notebooks and other accessories. The compartment includes a pair of L-shaped latches 26 that releasably seat within cavities on the housing front surface. Hooks can be deployed from a chamber on the bottom wall for suspending a trash bag.

Figure 8:
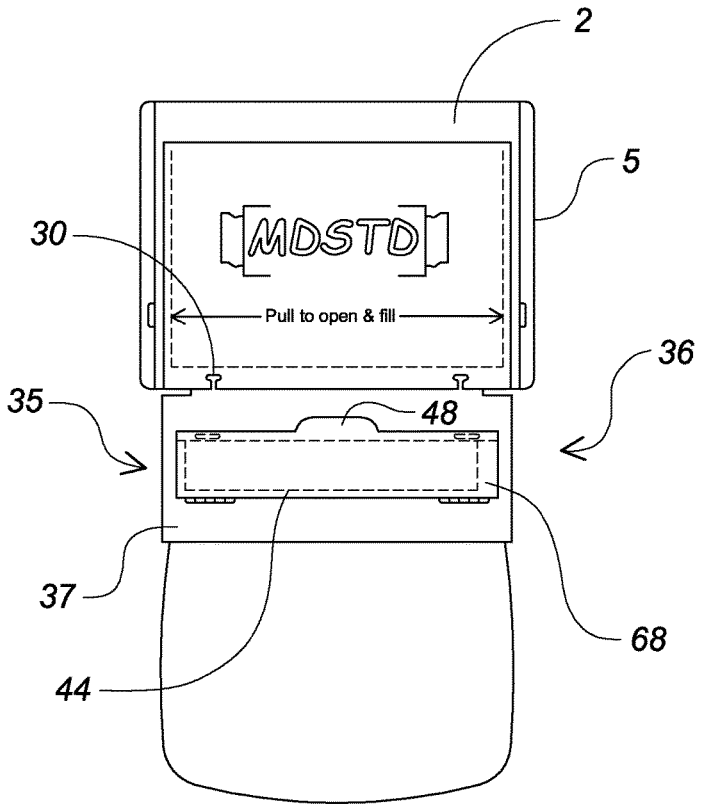
FIG. 8 is a front, plan view of a slightly different embodiment that includes an attachable trash receptacle.
Figure 9:
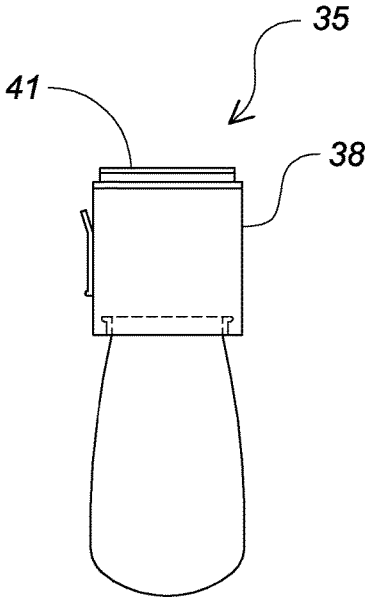
FIG. 9 is an isolated, side view of the detachable trash receptacle.
Figure 10:
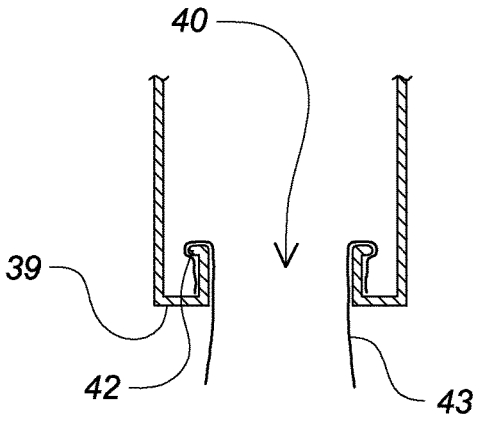
FIG. 10 is a side, cross-sectional view of the casing.

Now referring to FIGS. 8-10, a slightly different embodiment includes an attachable trash receptacle, depicted generally at 35, that provides a convenient means for collecting used tissues. In lieu of the deployable hooks, one or more grooves 30 with a substantially T-shaped cross section are formed on the bottom wall of the housing. The trash receptacle 35 is formed of a hollow casing 36 having a top wall, a front wall 37, a rear wall, a pair of sidewalls 38 and a bottom wall 39 with a longitudinal opening 40 formed thereon. On the top wall is one or more tongues 41 that are dimensioned and positioned to slidably mate with the grooves 30 to removably attach the casing to the housing bottom wall as depicted in FIG. 8.

The front wall 37 includes a hinged door 68 superimposed on a trash-receiving slot 44 that is in communication with the casing interior. The door 68 includes a tab 48 at an upper edge that a user grasps to open and close the door when discarding used tissues. Surrounding the opening 40 is one or more L-shaped retainers 42 for gripping the upper edge of a trash bag 43 as depicted in FIG. 10.

Accordingly, a user secures the housing to a side edge of a vehicle passenger seat or another convenient support surface and opens one of the doors to transfer tissues from a conventional tissue box into the interior tissue chamber. A tissue can be removed from either slot, thereby providing easy access by a passenger seated within either the front or rear seats.

For the embodiment depicted in FIGS. 8-10, a user slidably attaches the casing to the housing, opens the door and inserts a bag into the casing interior. The upper edge of the bag is secured to the retainers and is passed through the bottom opening. When the bag is full, a user simply pulls it from the retainers and discards the bag and enclosed tissues.

The above-described device is not limited to the exact details of construction and enumeration of parts provided herein. For example, though the clamps have been depicted and described as "D-shaped," any other shape can also be used. Furthermore, the size, shape and materials of construction of the other components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tissue dispenser for a vehicle comprising:

a hollow housing having a front surface, a rear surface, a top wall, a bottom wall and at least one hinged door that provides selective access to an interior tissue chamber having tissues therein;

a dispensing slot on said hinged door, said dispensing slot in communication with said tissue chamber for accessing tissues;

means for attaching said housing to a support surface;

a hollow casing having an interior, a top wall and a bottom wall, said bottom wall having a longitudinal opening formed thereon that is communication with said interior;

means for removably attaching the casing to the lower end of said housing;

means for securing a trash bag within the longitudinal opening on the bottom wall of the casing.

2. The tissue dispenser for a vehicle according to claim 1 wherein said means for removably attaching the casing to the lower end of said housing comprises:

at least one groove on the bottom wall of said housing;

at least one tongue on the top wall of said casing, said tongue dimensioned and positioned to slidably mate with said groove.

3. The tissue dispenser for a vehicle according to claim 1 wherein said means for securing a trash bag within the longitudinal opening formed on the bottom wall of the casing comprises at least one retainer adjacent to said longitudinal opening.

4. The tissue dispenser for a vehicle according to claim 1 wherein said means for attaching said housing to a support surface comprises a pair of spring-biased clamps on the rear surface of said housing for releasably gripping the support surface.

5. The tissue dispenser for a vehicle according to claim 1 further comprising a storage compartment removably attached to the front surface of the housing for retaining accessories.

6. The tissue dispenser for a vehicle according to claim 1 further comprising a hinged door on the front wall of said casing, said hinged door superimposed on a trash-receiving slot in communication with the interior of said casing for depositing trash into said trash bag.

7. The tissue dispenser for a vehicle according to claim 6 wherein said hinged door includes a tab at an upper edge that a user grasps to open and close the door when discarding used tissues.

* * * * *